US005531055A

United States Patent [19]

Sell et al.

[11] Patent Number: 5,531,055

[45] Date of Patent: Jul. 2, 1996

[54] REFILL ASSEMBLY AND SYSTEM FOR INK-JET PRINTER CARTRIDGES

[75] Inventors: Ryan M. Sell, Frankfort; Christopher L. Allgeier, Sr., Louisville; Martin A. Carpenter, Bardstown; Mordechai Lev, Lexington; William T. Kearney, III, Lexington; William G. Goff, III, Lexington; Joseph E. Domhoff, Shelbyville; Jonathan K. Voet, Lexington, all of Ky.

[73] Assignee: Nu-Kote International, Inc., Rochester, N.Y.

[21] Appl. No.: 315,968

[22] Filed: Sep. 30, 1994

Related U.S. Application Data

[63] Continuation-in-part of Ser. No. 223,768, Apr. 4, 1994.

[51] Int. Cl.[6] ..... B65B 31/00

[52] U.S. Cl. ..... 53/86; 53/238; 53/283; 53/305; 53/240

[58] Field of Search ..... 53/86, 97, 238, 53/240, 281, 283, 287, 305, 381.2; 347/86, 87

[56] References Cited

U.S. PATENT DOCUMENTS

| | | | |
|---|---|---|---|
| D. 135,679 | 5/1943 | McIntosh . | |
| D. 239,596 | 4/1976 | Dogliotti . | |
| D. 239,697 | 4/1976 | Hunt . | |
| D. 313,346 | 1/1991 | Fiore . | |
| D. 322,027 | 12/1991 | Knudsen et al. . | |
| D. 325,519 | 4/1992 | Proctor . | |
| D. 341,619 | 11/1993 | Ujita et al. . | |
| D. 341,620 | 11/1993 | Ujita et al. . | |
| D. 352,060 | 11/1994 | Kubota et al. . | |
| 3,482,258 | 12/1969 | Steen . | |
| 4,187,511 | 2/1980 | Robinson . | |
| 4,500,895 | 2/1985 | Buck et al. . | |
| 4,501,383 | 2/1985 | Iannelli . | |
| 4,677,448 | 6/1987 | Mizusawa et al. . | |
| 4,700,202 | 10/1987 | Kuranishi et al. . | |
| 4,929,109 | 5/1990 | Ikenaga . | |
| 4,967,207 | 10/1990 | Ruder . | |
| 4,968,998 | 11/1990 | Allen | 347/86 |
| 5,039,999 | 8/1991 | Winslow et al. . | |
| 5,040,001 | 8/1991 | Dunn et al. . | |
| 5,185,615 | 2/1993 | Koctabashi et al. | 346/1.1 |
| 5,199,470 | 4/1993 | Goldman . | |
| 5,280,300 | 1/1994 | Fong et al. . | |
| 5,329,294 | 7/1994 | Ontawar et al. . | |
| 5,341,161 | 8/1994 | Yamakawa et al. . | |
| 5,426,493 | 6/1995 | Oyler | 355/260 |
| 5,444,473 | 8/1995 | Hattori et al. | 347/87 |

FOREIGN PATENT DOCUMENTS

| | | | |
|---|---|---|---|
| 567308 | 10/1993 | European Pat. Off. . | |
| 568124 | 11/1993 | European Pat. Off. . | |
| 594055 | 4/1994 | European Pat. Off. . | |
| 603910 | 6/1994 | European Pat. Off. . | |
| 611656 | 8/1994 | European Pat. Off. . | |
| 3401071 | 7/1985 | Germany . | |
| 2047213 | 11/1980 | United Kingdom | 53/281 |
| WO94/11195 | 5/1994 | WIPO . | |

*Primary Examiner*—John Sipos
*Assistant Examiner*—Ed Tolan
*Attorney, Agent, or Firm*—Fay, Sharpe, Beall, Fagan, Minnich & McKee

[57] ABSTRACT

An assembly for refilling a printer cartridge includes a base that receives the printer cartridge to be refilled. A lid is located on the base and includes separate stations that sequentially open a refill opening, provide a predetermined amount of air to an equalize opening of the cartridge, dispense ink through the refill opening into the cartridge, and seal the refill opening. In a preferred embodiment, the four stations are mounted on the lid that is rotatable about an axis. The lid forms a seal with the printer cartridge so that air flow to an internal chamber of the cartridge is controlled during the refill process. The base contains any spills, mess, or the like, overcoming the types of problems associated with other ink refill processes and provides an accurate, dependable refill of ink to the printer cartridge.

16 Claims, 7 Drawing Sheets

REFILL ASSEMBLY AND SYSTEM FOR INK-JET PRINTER CARTRIDGES

CROSS REFERENCE TO RELATED APPLICATIONS

This is a continuation-in-part application of pending U.S. Ser. No. 08/223,768 of Christopher L. Allgeier, Sr. and Ryan M. Sell for "Method of Refilling Ink Jet Printer Cartridges" filed Apr. 4, 1994. The details of that application are incorporated herein by reference.

BACKGROUND OF THE INVENTION

This invention pertains to the art of printer cartridges, and more particularly to ink-jet printer cartridges such as a high capacity print cartridge sold as the Hewlett Packard® DeskJet/DeskWriter® 51626A High Capacity Print Cartridge. The invention is particularly applicable to a method of refilling an empty ink-jet printer cartridge of this type and will be described with particular reference thereto. It will be appreciated, however, that details of this invention may be advantageously employed in related environments and with other commercially available printer cartridges.

Ink-jet printer technology typically employs a cartridge or housing that carries a quantity of ink in an internal chamber or cavity that is formed into droplets for dispensing through a nozzle and onto a printing medium such as paper. For example, ink droplets are formed in response to an electrical signal that heats the ink and creates an ink vapor bubble that pushes ink out of the nozzle. An electrical resistive element heats the ink in an extremely rapid fashion so that it can be dispensed in a matter of milliseconds. Still other structures can be used to dispense ink droplets onto paper, the details of these ink-jet printer technologies being well known in the art. Since the structure and operation of printer cartridges of this type are well known in the art, further discussion herein is deemed unnecessary.

Ink-jet printer cartridges of this type are sold as original equipment and not promoted for reuse. It is generally recognized, however, that the costs associated with a new printer cartridge need not be encountered since additional savings can result from refilling an empty printer cartridge. In fact, it is believed that a substantial savings can result for the consumer when a single printer cartridge is refilled a number of times.

The above-identified parent application particularly teaches a preferred arrangement and method for refilling an empty printer cartridge. Likewise, U.S. Pat. No. 5,329,294 describes another arrangement and method for refilling an empty cartridge. The teachings of that patent are also incorporated herein by reference.

Known arrangements suffer from various problems, some of which are addressed by the above-noted application. For example, ink may be wasted or leak from the printer cartridge during the refill process. Suppliers of refill kits recognize this problem and suggest that the consumer use special containers or absorbent pads during the refill procedure to capture overrun ink. Still another problem is the chance that a user will not properly follow instructions provided with the refill kit. This can result in improper introduction of ink into the cartridge, some of which may be spilled or unnecessarily expelled from the printer cartridge. Other users may improperly prime the refilled printer cartridge.

Accordingly, a system and assembly that eliminates, or at least substantially curtails, common errors encountered during the refill process are required. Thus, it is desired to provide a new system that overcomes these and other problems in a reliable, easy to use manner that eliminates the potential for problems to develop.

SUMMARY OF THE INVENTION

The present invention contemplates a new and improved refill assembly and system that overcomes the above-referenced problems and others and provides an inexpensive and accurate apparatus and method for refilling printer cartridges.

According to the present invention, the assembly includes a base member that is adapted to receive a printer cartridge. A lid is received on the base and has separate stations that perform independent operations of the refill process.

According to a more limited aspect of the invention, the lid forms a seal with the printer cartridge so that air flow to an internal chamber of the printer cartridge is controlled during the refill process.

According to yet another aspect of the invention, the assembly refills the cartridge to the same capacity as the original equipment manufacturer and ultimately seals the cartridge once the refill process is complete.

According to yet another aspect of the invention, a predetermined quantity of air is introduced into the cartridge.

A primary advantage of the invention resides in a semi-automated refilling procedure for a printer cartridge.

Yet another advantage of the present invention is found in the elimination of errors associated with the refilling process.

Still another advantage of the invention is realized by the accurate refill of ink to the printer cartridge in a manner that contains any spills, mess, or the like.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred assembly or refill system and method of which will be described in detail in this specification and illustrated in the accompanying drawings which form a part hereof, and wherein.

DETAILED DESCRIPTION OF THE PREFERRED EMBODIMENT

Figure 1:
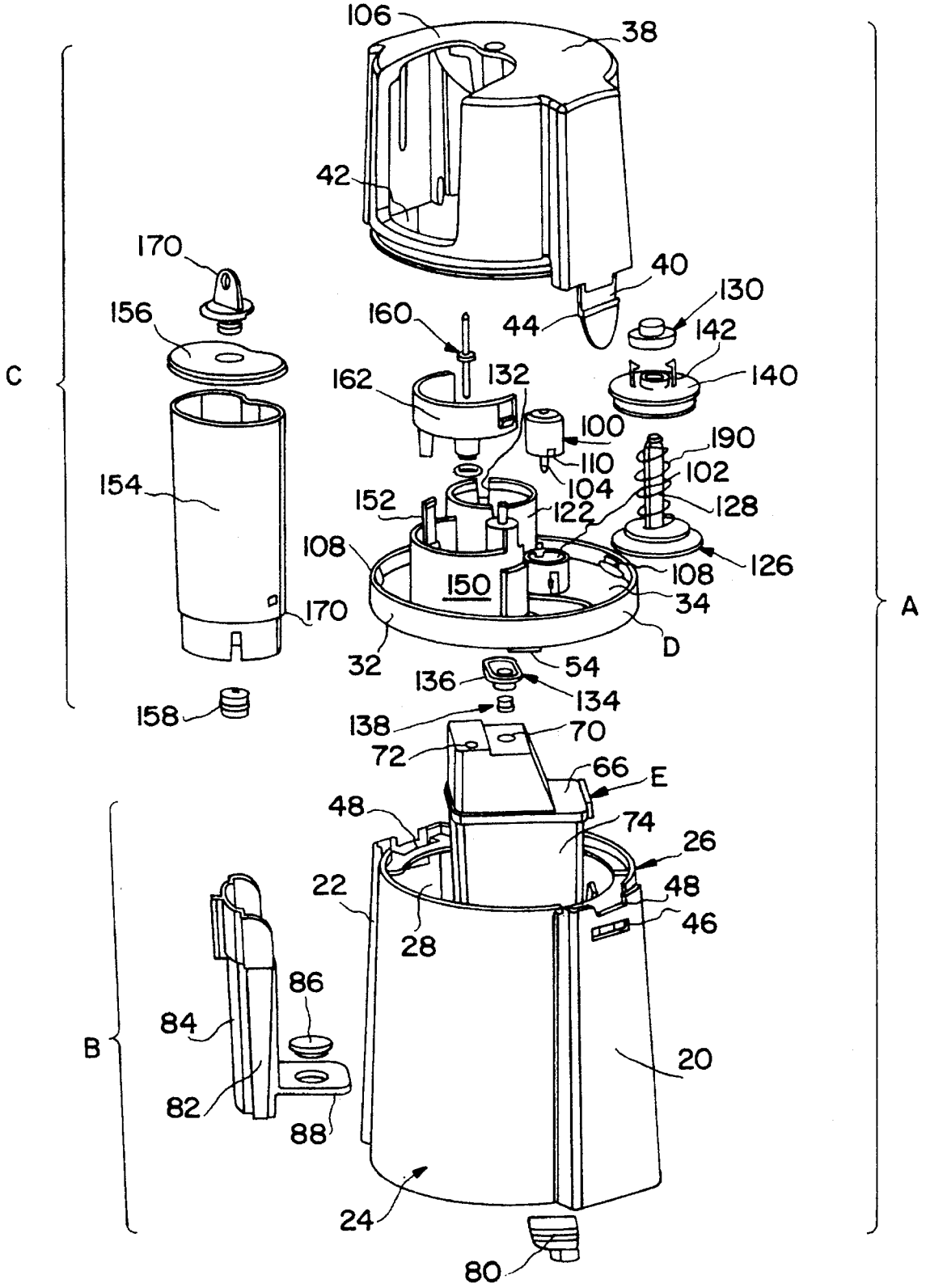
FIG. 1 is an exploded view of the individual components that comprise the subject new assembly.

Referring now to the drawings wherein the showings are for the purposes of illustrating the preferred embodiment of the invention only and not for purposes of limiting same, the FIGURES show a refill assembly A having a base B and a lid C that includes a rotatable disk D having separate work stations for undertaking individual steps in refilling a printer cartridge E.

More particularly, and with reference to FIG. 1, the base B is preferably of molded plastic construction and has a generally cylindrical or tapered cylindrical configuration with a pair of side bosses 20, 22. The bosses extend from a first or closed end 24 of the base to a second or open end 26. Accordingly, the base defines a cup-shaped container having an internal cavity 28 adapted to receive a used or empty printer cartridge E.

The open end of the base is adapted to receive the disk D. The disk has a generally circular outer wall 32 and a generally planar platform 34. Individual stations are mounted on the upper surface of the platform and will be described in greater detail below. However, it should be understood that each station performs an individual step in the refill process and by selectively rotating the disk relative to the base in which the printer cartridge is mounted, the individual steps of the refill process may be performed on the printer cartridge.

Received over the disk is a cap 38 which has a latching assembly defined by a pair of downwardly extending legs 40, 42. Each leg includes a raised area 44 that cooperates with an opening 46 in the bosses 20, 22 of the base to provide a snap-fit latching connection of the lid (i.e., the cap and disk) to the base. The legs have some flexibility so that they can be deformed inwardly toward one another for receipt in slots 48 defined in the second end 26 of the base. Upon continued axial insertion of the lid C, the resilient character of these legs urge the raised portions 44 outwardly through openings 46 to lock the lid, disk, and base together. It will be understood, however, that the disk can still rotate relative to the base when the cap 38 is mounted on the base.

Figure 2:
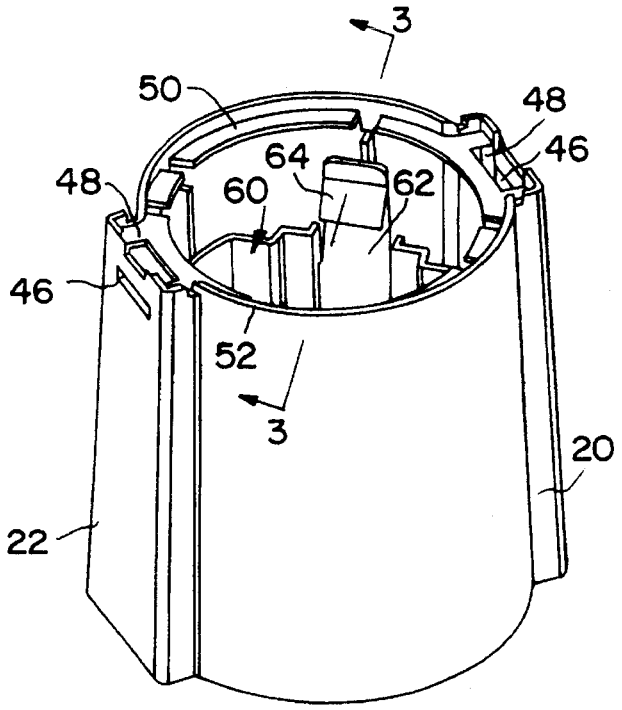
FIG. 2 is a perspective view of the base of the new assembly.
Figure 3:
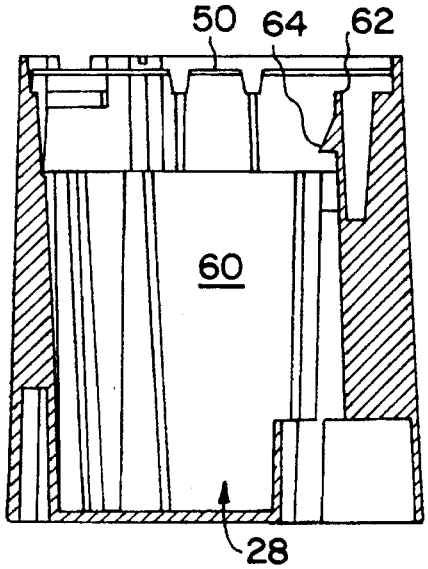
FIG. 3 is a longitudinal cross section of the base of FIG. 2 taken generally along the lines 3—3 thereof.

With continued reference to FIG. 1, and additional reference to FIGS. 2 and 3, a ledge 50 is spaced inwardly from the upper terminal end of the base. The ledge is substantially circumferentially continuous, although a gap 52 in the ledge cooperates with an outwardly extending tab 54 on the underside of the disk (FIG. 1) to define a keyed connection between the disk and base. That is, the tab must be circumferentially aligned with the gap 52 to allow axial insertion of the tab beneath the ledge 50. Once the disk is rotated from that position, the disk cannot be axially removed from the base until the tab and gap are aligned since the tab rides on the underside of the ledge and prevents pull out.

An internal wall structure 60 is rigidly mounted within the cavity 28 of the base. In the preferred embodiment, the wall structure is integrally molded with the remainder of the base. The wall structure is dimensioned to closely receive a printer cartridge therein. A latching arrangement such as flexible tab 62 (FIGS. 2 and 3) has an inwardly extending lip 64 that extends over a shoulder 66 (FIG. 1) of the printer cartridge once the cartridge is completely received therein. This provides for proper orientation of the printer cartridge in the base, and, in fact, the walled structure is so dimensioned as to be permitted to receive the printer cartridge in only a single orientation.

For reasons which will become more apparent below, the walled structure and base are designed to locate an equalize opening 70 generally along the axial centerline of the refill assembly A. The refill opening 72, on the other hand, is radially offset from the centerline. As is known in the art, the equalize opening 70 communicates with one or more inflatable bladders (not shown) within a base 74 of the printer cartridge. The bladders are normally urged to a deflated condition by one or more springs that compress the bladders. Again, particular details of the structure and operation of a printer cartridge are well known in the art and generally form no part of the subject invention.

Also disposed in the base is a first seal member 80 that is located within the walled structure 60 and adjacent the closed end 24 of the base (FIG. 1). The first seal member defines a nozzle seal that presses against small openings that define the nozzles in the printer cartridge when the cartridge is disposed in latched relation within the wall structure.

An overflow reservoir 82 is defined in a removable wall member 84, and particular details of the reservoir will be described below. A second seal member 86 is carried by a flange 88 of the wall member 84 to define a bubbler seal and covers the vent hole in the base of the printer cartridge. Again, once the printer cartridge is disposed in latched relation within the wall structure, the second seal member 86 closes the vent hole (not shown) in the bottom portion of the printer cartridge.

Figure 4:
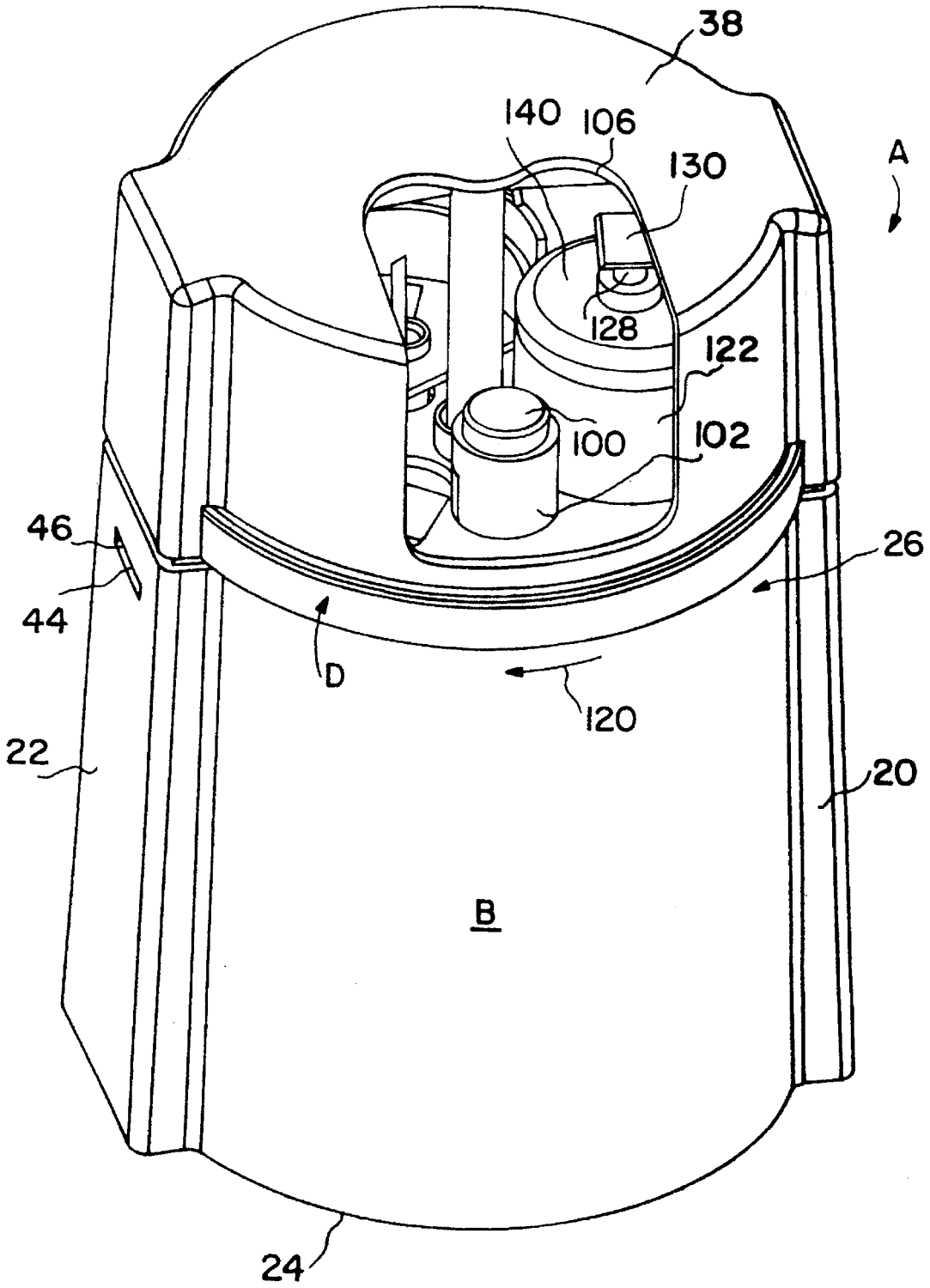
FIG. 4 is a perspective view of the subject new assembly with the first station positioned in a operative location.

With continued reference to FIG. 1, and additional reference to FIGS. 4–8, the structure and operation of the individual stations located on the rotatable disk will be described in greater detail. According to the preferred arrangement, four individual stations are located on the disk. The first station is best shown in FIG. 4. It comprises a plunger or pusher member 100 received in an associated well 102. Interposed between the pusher member and the well is a spring that biases the pusher member outwardly away from the platform of the disk member. As shown in FIG. 1, the pusher member includes a stem 104 that extends through an opening in the base of the well and through the platform 34 of the disk. The opening is defined at a preselected radial location from the central axis of the refill assembly. Specifically, it is spaced from the central axis by a dimension that is the same dimension from the centerline as the refill opening is spaced from the equalize opening in the printer cartridge. In this manner, when the first station is rotated to an operative position as shown in FIG. 4, i.e., where the pusher member 100 is accessible through station opening 106 in the cap, the stem 104 is located directly over the refill opening 72 of the printer cartridge latched in the base. Upon depression of the plunger against the outward bias of the spring and into the well 102, the stem 104 is advanced through the underside of the platform and punches an opening in the material that covers the refill opening 72 of the printer cartridge. This is the first stage operation that provides access to the interior cavity by opening a passage through the refill opening 72. The material that is removed from the refill opening is urged inwardly into the printer cartridge cavity and has no adverse impact on later operation of the printer cartridge.

To assure proper orientation of the stations relative to the station opening 106, tabs 108 are provided adjacent the wall 32 at spaced locations corresponding to each individual station. The tabs 108 cooperate with a recess or detent in the cap (not shown) to assure proper rotational position of the disk relative to the printer cartridge.

Figure 6:
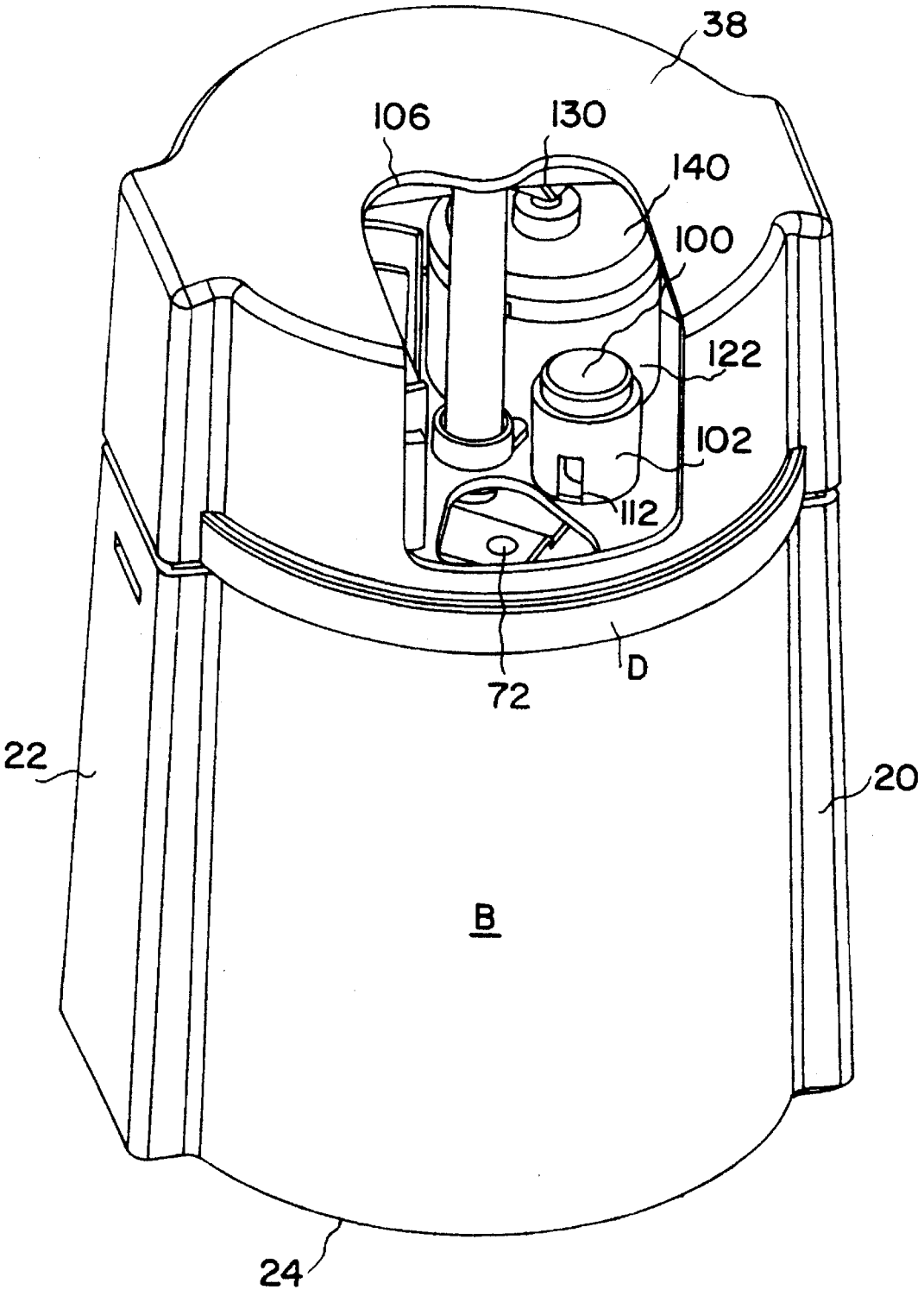
FIG. 6 is another perspective view similar to FIG. 4 with the fourth station shown in operative location.
Figure 7:
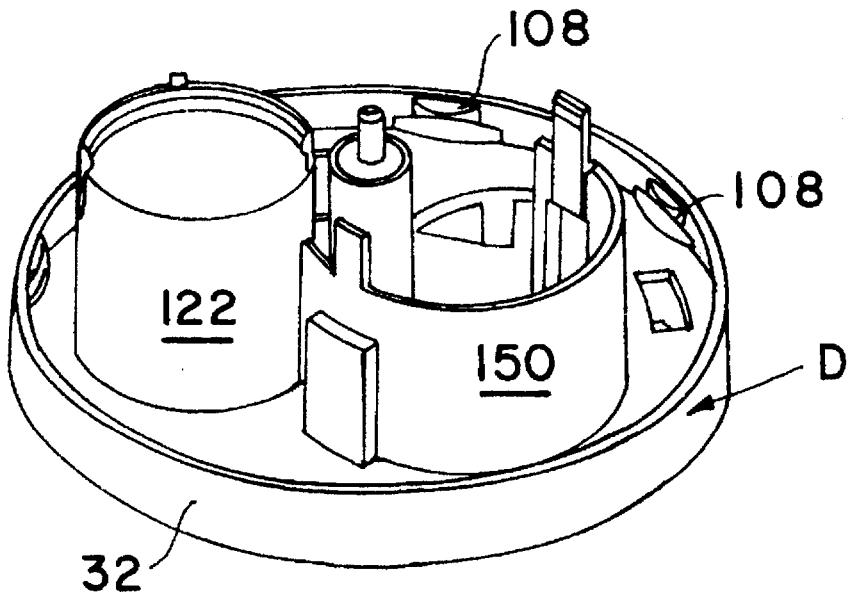
FIG. 7 is a top perspective view of the rotatable disk of the lid which illustrates the separate stations received thereon.
Figure 8:
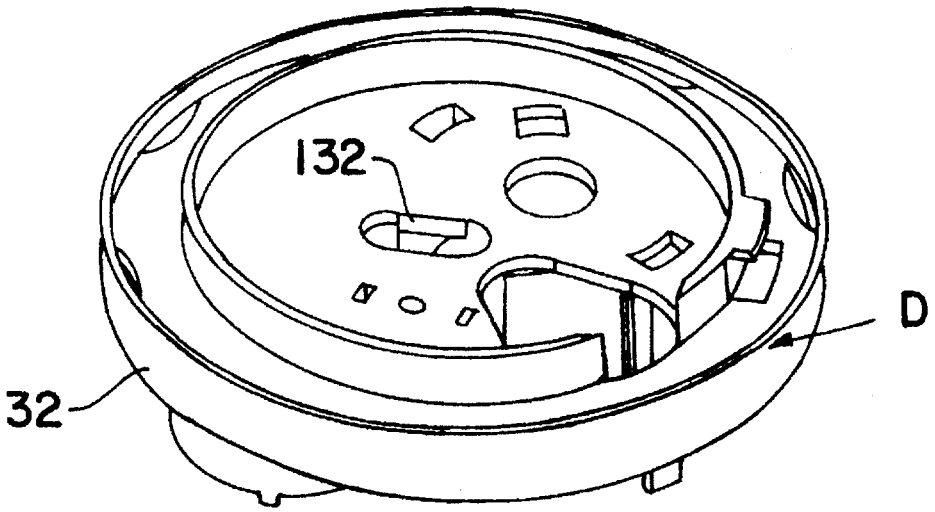
FIG. 8 is a perspective view of the underside of the rotatable disk.

A finger 110 (FIG. 1) extends from the pusher member and is received in elongated opening 112 formed in the side wall of the well 102 (FIG. 6). The finger and opposite ends of opening 112 cooperate to define upper and lower limits of movement of the pusher member. That is, the spring urges the pusher member outwardly until the finger engages the upper extent of the opening 112. This is the normal, outwardly biased, inoperative position of the pusher member. Actuation or depression of the pusher member against the bias of the spring advances the pusher member and stem 104 downwardly. The downward movement is then limited by finger 110 engaging the bottom end of opening 112, or some other stop surface.

Once the refill opening has been breached, the disk is rotated in the direction shown by arrow 120 (FIG. 4) to bring the second station into alignment with the station opening 106 in the cap. The second station provides a predetermined quantity of air to the bladders in a unique manner. Specifically, an enlarged well 122 extends outwardly from the upper surface of the platform 34. The well defines the housing or cylinder portion of a piston cylinder device. A piston assembly 124 includes a flexible piston member 126 and a piston rod 128. The piston provides sealing engagement with the inner surface of the well 122 so that depression or actuation of button or plunger 130 mounted on the outer end of the piston rod urges the piston toward the platform surface. An opening 132 (FIG. 1) formed in the side wall of the well 122 defines the region where compression of air beneath the piston begins. That is, once the piston passes the bottom of the opening 132, there is only one additional opening through which the air can pass. That opening 132 is formed in the platform (FIG. 8) and is of elongated dimension. A plug 134 is received in the opening and includes a seal 136 around its periphery to provide a closed or sealed passage of air from the radial outer direction toward the central axis of the assembly. The plug 134 has a passage 136 that defines a channel from the base of the well 122 of the second station through an additional seal member, such as O-ring 138, for sealed communication with the equalize opening 70. Thus, air flow is directed axially through the platform, radially along the channel defined in the plug 134, axially through the opening 136, and into the equalize opening of the printer cartridge.

The keyed connection between the disk and the base described above with reference to tab 54 and ledge 50 also adds the additional feature of assuring a sealed connection between the equalize opening 70 of the printer cartridge and the underside of the disk, specifically O-ring 138 (FIG. 1). Thus, even though the disk is rotated from one station to another, the seal between the disk and the equalize opening of the printer cartridge is always maintained until the refill process is complete.

A piston cap or end wall 140 is secured to the upper end of the well 122. It advantageously includes a set of latching fingers 142 that maintain the piston in a depressed position once the button is advanced through the latching fingers. In this manner, air supplied to the bladders of the printer cartridge remains in the bladders until the refill process is complete. Of course other arrangements that maintain the piston in an actuated state can be used as opposed to the latching fingers 142 gripping the upper surface of the plunger 130.

As will be recognized, although the bladders are filled with air during the second station operation, the remainder of the printer cartridge cavity is open to atmosphere via the refill opening 72. Accordingly, the bladders are expanded and consume a portion of the interior cavity of the printer cartridge. The bladders remain in this state until the seal is breached between the underside of the disk and around the equalize opening of the printer cartridge, i.e., upon completion of the refill process.

Figure 5:
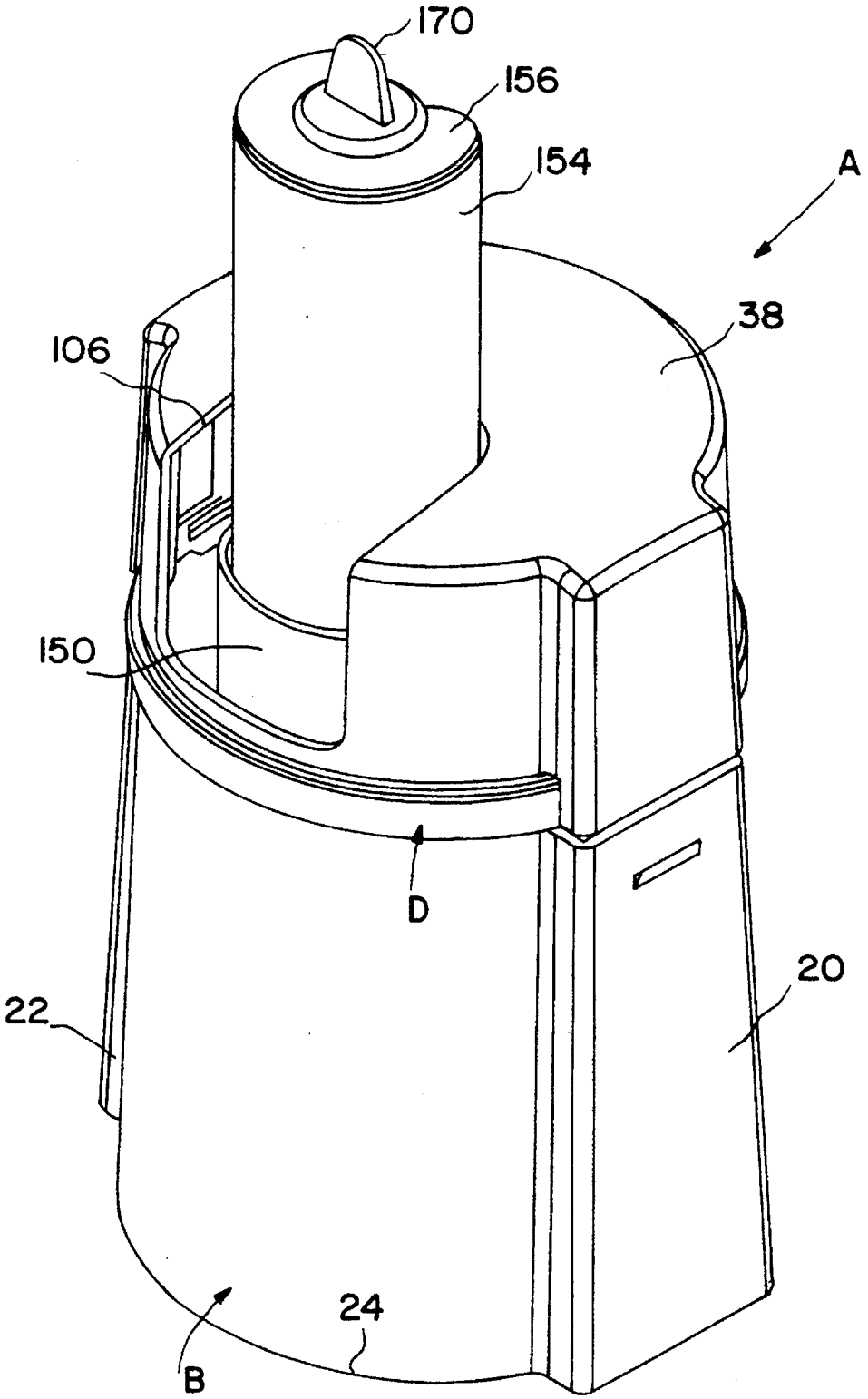
FIG. 5 is a perspective view similar to FIG. 4 showing the third station in an operative location and receiving an ink refill tank.
Figure 9:
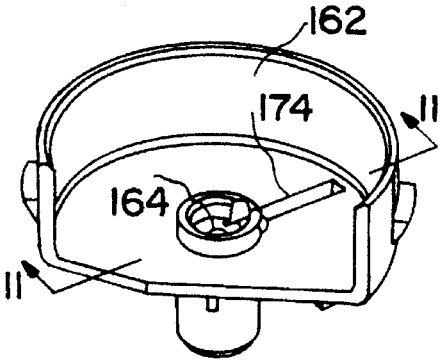
FIG. 9 is a perspective view of the third station with selected components removed for ease of illustration.
Figure 10:
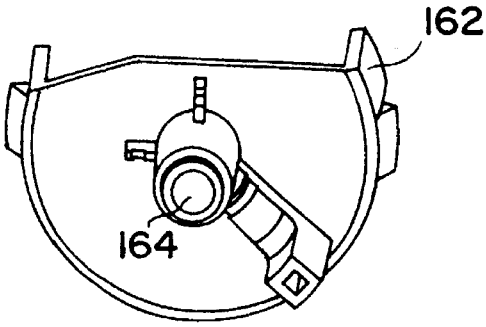
FIG. 10 is a view of the underside of FIG. 9.
Figure 11:
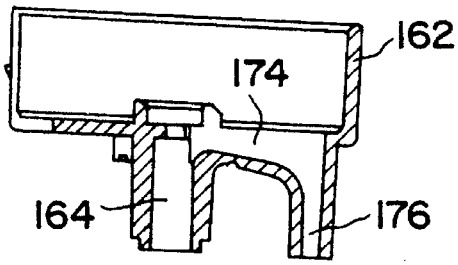
FIG. 11 is a longitudinal cross-sectional view of the third station taken generally along the lines 11—11 of FIG. 9.
Figure 14:
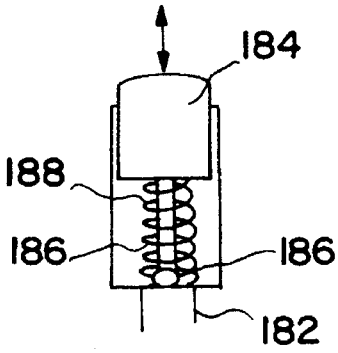

The third station on the platform is next brought into alignment with the station opening 106 of the cap (FIG. 5). The third station is defined by a semicircular shaped well 150 that extends upwardly from the platform surface. It includes a plurality of integrally formed fingers 152 (FIG. 1) that are adapted to grip the outer surface of an ink tank 154 containing a premeasured quantity of ink used in the refill process. The ink tank 154 is closed by a cap or end wall 156 at one end and a seal member 158 at the other end. The tank seal member 158 is adapted to receive a needle 160 that is positioned in needle housing 162. More particular details of the needle housing 162 are shown in FIGS. 9–11 where the needle has been removed for ease of illustration. The needle housing has a central opening 164 in which the needle is positioned to pierce through seal member 158 when the ink tank is inserted into the needle housing. When tank plug 170 (FIG. 1) is removed from the cap of the ink tank, ink will flow from the tank, through needle, through the central opening 164 of the housing, and into the printer cartridge through refill opening 72. As will be recognized, the needle housing is biased outwardly by a spring (not shown) relative to its well 150. When the ink tank is received in the needle housing, the tank and housing are both advanced axially toward the platform and overcome the bias of the spring. The latch fingers 152 then engage tabs 170 on the outer surface of the ink tank to secure the ink tank in place. This axial movement also advances the bottom end of the needle 160 into the refill opening 72 of the printer cartridge.

When the plug 170 is removed from the ink tank, ink will flow into the printer cartridge cavity and fill the cartridge with a premeasured quantity of ink. Once the ink is emptied from the tank, which may be monitored by the operator because of the transparent material forming the tank, the ink tank may be removed from the third station. The needle housing 162 is then biased outwardly from the platform by the spring and the lower end of the needle retracted from the refill opening 72. Operation of the third station, i.e., the ink refill step, is now complete and the disk may be rotated to align the fourth station with opening 106 in the cap.

An important feature of the third station is best shown in FIGS. 9–11. In addition to the central opening 164, a generally radial passage 174 communicates with a secondary opening 176. If the premeasured quantity of ink is more than can be handled in the printer cartridge cavity, excess ink will back up in opening 164, and be bypassed through radial passage 174 to opening 176. The opening 176 is located adjacent the overflow reservoir 82 in the base so that excess ink is stored therein. Thus, any excess ink is carefully captured by the refill assembly.

Rotation of the disk for positioning the fourth station in its operative location provides for closure of the refill opening.

Figure 12:
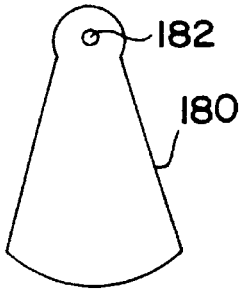
FIG. 12 is a top plan view of a portion of the fourth station with selected components removed for ease of illustration.
Figure 13:
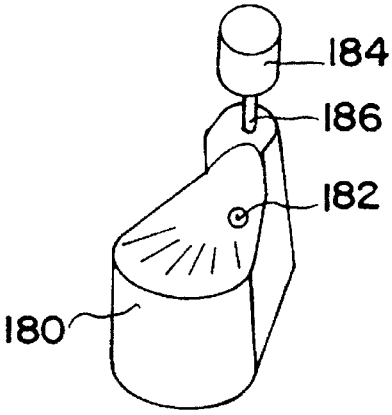
FIG. 13 is a perspective view of selected components of the fourth station; and, FIG. 14 is an elevational view of other selected components of the fourth station.

Small beads formed of plastic or other material are inserted into a funnelled well 180 (FIGS. 12 and 13) formed at the fourth station. The funnelled well 180 includes an opening 182 at the radial inner portion. The operator can simply drop the bead into the well, and its funnel shape advances the bead into opening 182. This opening is aligned directly over the refill opening 72 of the printer cartridge. To advance the bead into closing relationship and thereby seal the refill opening, an actuation member 184 having an elongated stem 186 is provided. The actuation member is depressed against the outward bias of spring 188 and the lower end of the stem 186 engages the bead, forcing it through the opening 182, and into operative, sealing relationship with the refill opening 72 of the printer cartridge. Upon release of the actuation member 184, the spring urges the actuation member and stem outwardly to complete the refill process.

The disk is then subsequently rotated to align the first station with the cap opening 106. The piston cap is released from the clips 142 which hold it in a depressed position during movement of the disk from the fourth station to the first station. The clips come in contact with members extending from the underside of the cap. This contact forces the clips 142 radially outward from the piston cap 140 simultaneously releasing the cap 140 to be forced axially upward by spring 190 (FIG. 1). This action deflates the air bladders in the cartridge which in turn, provides a greater volume for ink in the sealed printer cartridge thus exerting a negative or vacuum force on the ink stored in the cartridge. In this manner, ink is less likely to drip from or be expelled through the nozzle openings of the printer cartridge as it is removed from the refill assembly and re-inserted into the printer assembly.

As previously described, rotation of the disk to align the first station with the cap opening also aligns tab 54 with the gap 52 in the ledge so that the disk and cap may be subsequently removed from the base. This provides access to the printer cartridge E which has been heretofore stored in the base. Tab 62 is flexed radially outward so that the lip 64 allows the shoulder 66 of the printer cartridge to be removed axially from the base. Once the disk is separated from the base, the seal between O-ring 138 and the equalize opening 70 of the printer cartridge is broken.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An assembly for refilling a printer cartridge, the printer cartridge having an equalize opening that provides selective air communication with an interior of the printer cartridge and a refill opening that allows the printer cartridge to receive a new supply of ink therein, the assembly comprising:

a base for receiving a printer cartridge to be refilled;

a lid received on the base and having separate stations for performing distinct operations in refilling a printer cartridge, the lid also including a seal member for sealing the equalize opening of a printer cartridge when the lid is received on the base;

a first station on said lid having a pusher member that is positioned adjacent the refill opening, the pusher member adapted to open the refill opening upon actuation of the pusher member;

a second station on said lid that includes a plunger for providing a predetermined amount of air to the equalize opening upon actuation of the plunger;

a third station on said lid adapted to receive an ink container therein and dispense ink through the refill opening into the printer cartridge;

a fourth station on said lid including a recess for receiving a closure member and a member for advancing the closure member into the refill member and sealing the refill opening;

means for allowing movement of at least a portion of said lid relative to said cartridge to align each of said stations with said cartridge.

2. The assembly as defined in claim 1 wherein at least a portion of the lid is rotatably received on the base for selectively advancing the stations into operative position relative to a printer cartridge received in the base.

3. The assembly as defined in claim 1 further comprising a latch for temporarily securing the printer cartridge in the base during refilling of the printer cartridge.

4. The assembly as defined in claim 1 wherein the lid includes a cover that is non-rotatably attached to the base and allows the stations to rotate relative thereto.

5. The assembly as defined in claim 4 wherein the cover includes a latching assembly that temporarily secures the lid to the base.

6. The assembly as defined in claim 4 wherein the cover includes a cutout region that allows operator access to only one station at a time.

7. The assembly as defined in claim 1 further comprising an overflow reservoir that captures any excess ink that does not enter the printer cartridge.

8. The assembly as defined in claim 7 wherein the third station includes a passage that extends from adjacent the refill opening of the printer cartridge to the overflow reservoir.

9. The assembly as defined in claim 1 wherein the plunger of the second station includes a catch mechanism for temporarily holding the plunger in an actuated position.

10. The assembly as defined in claim 1 wherein the four stations are mounted on said lid, an axis of rotation of the lid aligned with the equalize opening of a printer cartridge received in the base.

11. The assembly as defined in claim 10 wherein the second station includes an air passage that has a generally radial portion for communicating with the equalize opening located on the axis of rotation of the disk.

12. The assembly as defined in claim 10 wherein the lid and base include a keyed connection assembly that requires the lid and base to be oriented in a preselected fashion to connect and disconnect them together.

13. The assembly as defined in claim 1 wherein the base includes a sidewall and end wall that form a cup-shaped cavity for receiving the printer cartridge and containing any inadvertent spillage of ink during refill of the printer cartridge.

14. The assembly as defined in claim 1 wherein the base includes an elastomeric pad adapted to receive the printer cartridge thereon and limit leakage from the printer cartridge.

15. The assembly as defined in claim 1 further comprising a removable overflow reservoir that captures any excess ink that does not enter the printer cartridge.

16. The assembly as defined in claim 1 wherein the second station is automatically released when the first station is again brought into alignment with the printer cartridge.

* * * * *